US007622009B2

(12) United States Patent
Kuwabara

(10) Patent No.: US 7,622,009 B2
(45) Date of Patent: Nov. 24, 2009

(54) STEEL MATERIAL

(75) Inventor: Mitsuo Kuwabara, Tsurugashima (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 2 days.

(21) Appl. No.: 10/472,468

(22) PCT Filed: Mar. 20, 2002

(86) PCT No.: PCT/JP02/02653

§ 371 (c)(1),
(2), (4) Date: Sep. 22, 2003

(87) PCT Pub. No.: WO02/075013

PCT Pub. Date: Sep. 26, 2002

(65) Prior Publication Data

US 2004/0069378 A1 Apr. 15, 2004

(30) Foreign Application Priority Data

Mar. 21, 2001 (JP) ..... 2001-080313
Mar. 21, 2001 (JP) ..... 2001-080328

(51) Int. Cl.
*C23C 8/26* (2006.01)
*C23C 8/22* (2006.01)

(52) U.S. Cl. ..... 148/224; 148/230; 148/318; 148/319

(58) Field of Classification Search ..... 148/320, 148/328, 224, 230, 318, 319
See application file for complete search history.

(56) References Cited

U.S. PATENT DOCUMENTS 3,146,616 A 9/1964 Loyd
4,011,107 A 3/1977 Hayes
4,177,091 A * 12/1979 Fiedler ..... 148/111

(Continued)

FOREIGN PATENT DOCUMENTS

CA 2022907 2/1991

(Continued)

OTHER PUBLICATIONS

Davis et al., The ASM Handbook, Aug. 31, 1991, vol. 4, pp. 312-315.*

(Continued)

*Primary Examiner*—Roy King
*Assistant Examiner*—Jessee R. Roe
(74) *Attorney, Agent, or Firm*—Birch, Stewart, Kolasch & Birch, LLP

(57) ABSTRACT

A raw steel is coated with or surrounded by a boron compound (step S1). A coating film of h-BN is formed on the surface of the raw steel. Then, the raw steel is nitrided by a nitriding gas while being heated (step S2). B from the boron compound and N from the nitriding gas are diffused into the raw steel, turning the raw steel into a steel material containing B and N. Most of B and N are present as an Fe (B, N) solid solution or an Fe (C, B, N) solid solution in the structure of the steel material. The raw steel is heated and nitrided under conditions such that B and N are contained ranging from 7 to 30 ppm by weight and ranging from 10 to 70 ppm by weight, respectively.

1 Claim, 9 Drawing Sheets

U.S. PATENT DOCUMENTS

| | | | | | |
|---|---|---|---|---|---|
| 4,297,387 | A | | 10/1981 | Beale | |
| 4,375,377 | A | * | 3/1983 | Ohtani et al. | 148/661 |
| 4,806,175 | A | | 2/1989 | Wendt | |
| 5,629,099 | A | * | 5/1997 | Sakurai et al. | 428/659 |
| 5,900,077 | A | * | 5/1999 | McVicker et al. | 148/334 |
| 6,294,029 | B1 | | 9/2001 | Sakate et al. | |

FOREIGN PATENT DOCUMENTS

| | | | | |
|---|---|---|---|---|
| GB | 1318887 | | | 5/1973 |
| JP | 49-105712 | | | 10/1974 |
| JP | 52-145345 | A | | 12/1977 |
| JP | 53-142933 | | | 12/1978 |
| JP | 55-161063 | A | | 12/1980 |
| JP | 58-039775 | A | | 3/1983 |
| JP | 4-128313 | | | 4/1992 |
| JP | 04-128313 | | * | 4/1992 |
| JP | 7-84639 | | | 9/1995 |
| JP | 8-176733 | | | 7/1996 |
| JP | 8-193242 | | | 7/1996 |
| JP | 2661650 | B2 | | 6/1997 |
| JP | 2474400 | | | 2/1998 |
| JP | 2747400 | | | 2/1998 |
| JP | 10-152746 | | * | 6/1998 |
| JP | 11-012685 | A | | 1/1999 |
| JP | 11012685 | A | * | 1/1999 |
| JP | 11-229078 | A | | 8/1999 |
| JP | 2000-63935 | | | 2/2000 |
| JP | 2000-160287 | | | 6/2000 |
| JP | 2000-219934 | A | | 8/2000 |
| JP | 2000-282170 | | | 10/2000 |
| JP | 2000-303161 | | | 10/2000 |
| JP | 4-128313 | | | 9/2002 |

OTHER PUBLICATIONS

Machine Translation of Eguchi (JP 10-152746).*
English Translation of Eguchi (JP 10-152746).*
Patnaik, Pradyot (2003). Handbook of Inorganic Chemicals., "Ammonia", (pp. 20-23). McGraw-Hill. Online version available at:http://www.knovel.com/knovel2/Toc.jsp?BookID=688 &VerticalID=0.
Merriman, A.D., 1958, A Dictionary of Metallurgy, "Induction Heating", pp. 136, Richard Clay and Company, Ltd., Bungay, Suffolk.

* cited by examiner

FIG. 2

| | VICKERS HARDNESS FROM ONE END TO THE OTHER | | | | | | | | | | |
|---|---|---|---|---|---|---|---|---|---|---|---|
| | 0.3 mm | 0.5 mm | 1.0 mm | 2.0 mm | 3.0 mm | 5.0 mm | 10 mm | 20 mm | 30 mm | 40 mm | OTHER END FACE |
| INVENTIVE EXAMPLE 1 | 746 | 754 | 743 | 765 | 754 | 746 | 743 | 754 | 746 | 743 | 746 |
| INVENTIVE EXAMPLE 2 | 720 | 738 | 746 | 743 | 728 | 738 | 738 | 746 | 728 | 720 | 743 |

FIG. 3

| TEST PIECE | TENSILE STRENGTH (MPa) | CHARPY IMPACT VALUE ($kgm/cm^2$) |
|---|---|---|
| INVENTIVE EXAMPLE 1 | 1260 | 12.4 |
| INVENTIVE EXAMPLE 2 | 1080 | 10.6 |
| COMPARATIVE EXAMPLE 1 | 780 | 7.3 |

FIG. 5

| HEAT-NITRIDING TIME (MIN.) | 10×10* | | | | 20×20* | | | | 30×30* | | | |
|---|---|---|---|---|---|---|---|---|---|---|---|---|
| | B (ppm) | $H_{RC}$ | TENSILE STRENGTH (MPa) | $K_{IC}$ | B (ppm) | $H_{RC}$ | TENSILE STRENGTH (MPa) | $K_{IC}$ | B (ppm) | $H_{RC}$ | TENSILE STRENGTH (MPa) | $K_{IC}$ |
| 5 | 14 | 66 | – | – | 14 | 66 | – | – | 14 | 66 | – | – |
| 10 | 14 | 66 | – | – | 14 | 66 | – | – | 14 | 66 | – | – |
| 15 | 15 | 67 | – | – | 14 | 66 | – | – | 14 | 66 | – | – |
| 20 | 15 | 67 | – | – | 14 | 67 | – | – | 14 | 66 | – | – |
| 30 | 16 | 67 | – | – | 15 | 67 | – | – | 14 | 66 | – | – |
| 45 | 16 | 67 | – | – | 15 | 67 | – | – | 15 | 66 | – | – |
| 60 | 17 | 67 | – | – | 16 | 67 | – | – | 15 | 67 | – | – |
| 80 | 17 | 67 | – | – | 17 | 67 | – | – | 15 | 67 | – | – |
| 120 | 18 | 68 | – | – | 17 | 67 | – | – | 16 | 67 | – | – |

*INDICATES LONGITUDINAL AND TRANSVERSE DIMENSIONS (mm)

FIG. 6

| HEAT-NITRIDING TIME (MIN.) | 40×40* | | | | 50×50* | | | | 60×60* | | | | 70×70* | | | |
|---|---|---|---|---|---|---|---|---|---|---|---|---|---|---|---|---|
| | B (ppm) | $H_{RC}$ | TENSILE STRENGTH (MPa) | $K_{IC}$ | B (ppm) | $H_{RC}$ | TENSILE STRENGTH (MPa) | $K_{IC}$ | B (ppm) | $H_{RC}$ | TENSILE STRENGTH (MPa) | $K_{IC}$ | B (ppm) | $H_{RC}$ | TENSILE STRENGTH (MPa) | $K_{IC}$ |
| 5 | 14 | 65 | 1480 | 62 | 14 | 65 | 1340 | 56 | 13 | 64 | 1280 | 52 | 13 | 63 | 1240 | 51 |
| 10 | 14 | 65 | 1460 | 60 | 14 | 65 | 1360 | 56 | 14 | 64 | 1240 | 52 | 13 | 63 | 1180 | 51 |
| 15 | 14 | 65 | 1460 | 61 | 14 | 65 | 1420 | 62 | 14 | 65 | 1340 | 57 | 14 | 63 | 1280 | 52 |
| 20 | 14 | 66 | 1580 | 67 | 14 | 66 | 1560 | 66 | 14 | 65 | 1460 | 61 | 14 | 64 | 1360 | 56 |
| 30 | 14 | 66 | 1640 | 74 | 14 | 66 | 1610 | 71 | 14 | 65 | 1480 | 62 | 14 | 65 | 1460 | 57 |
| 45 | 15 | 66 | 1680 | 75 | 14 | 66 | 1660 | 76 | 14 | 66 | 1650 | 74 | 14 | 65 | 1480 | 56 |
| 60 | 15 | 66 | 1680 | 75 | 15 | 66 | 1680 | 75 | 15 | 66 | 1680 | 76 | 15 | 65 | 1520 | 56 |
| 80 | 15 | 66 | 1470 | 56 | 15 | 66 | 1650 | 74 | 15 | 66 | 1640 | 74 | 15 | 66 | 1660 | 74 |
| 120 | 16 | 67 | 1380 | 47 | 16 | 67 | 1340 | 41 | 15 | 66 | 1650 | 74 | 15 | 66 | 1640 | 75 |

*INDICATES LONGITUDINAL AND TRANSVERSE DIMENSIONS (mm)

STEEL MATERIAL

This application is the national phase under 35 U.S.C. § 371 of PCT International Application No. PCT/JP02/02653 which has an International filing date of Mar. 20, 2002, which designated the United States of America.

TECHNICAL FILED

The present invention relates to a steel material containing B (boron) and N (nitrogen), and a method of manufacturing such a steel material.

BACKGROUND ART

Steel material of Fe-C alloy is one of the most general metal materials. Particularly, steel materials containing some elements are referred to as special steel, and widely used as raw materials for structural members, tools, and jigs.

Elements contained in the special steels include Al, B, Co, Cr, Mn, Mo, N, Ni, Pb, S, V, Ti, Ta, W, and Zr. These elements improve the characteristics of steel materials by being contained in certain proportions. For example, a boron steel containing B in the range from 40 to 70 ppm by weight (hereinafter, the unit of "ppm" refers to "ppm by weight" unless otherwise specified) exhibits better mechanical strength, hardness, and toughness than general steel materials. A steel containing Pb is known as a free cutting steel that can highly easily be cut off.

Those elements in steel materials are present in different states. Almost all elements are present as a solid solution or compound with ferrite (a solid solution with α-Fe and C) of the steel material, or as a solid solution or compound with cementite ($Fe_3C$). Some elements may be present as nonmetal compounds such as oxides or sulfides or intermetallic compounds. In the Pb free cutting steel, Pb is present by itself in the steel material without being bonded to other elements.

While a steel material is being rolled, forged or otherwise plastically formed into a desired shape, it is customary to treat the surface thereof by hardening, carburizing, nitriding, etc. In the hardening process, the surface of a steel material is heated to produce an austenite (a solid solution with γ-Fe and C), and then rapidly cooled to produce a martensite. In the carburizing and nitriding processes, after a steel material is heated, C or N is introduced into the steel material from its surface. These surface treatment processes result in a case-hardened steel material.

A boron steel tends to crack while being quenched, and any boron steel workpieces with cracks cannot be used as products. Stated otherwise, when a boron steel is quenched, the yield is lowered. The reason why a boron steel tends to crack is that a trace of Fe, C, Si, Ni, Mo, or the like which is present as a separate impurity in the steel material reacts with B, generating a brittle material such as FeB, $Fe_2B$, $Fe_5SiB_2$, $Ni_4B_3$, $MoFeB_4$, $MO_2FeB_2$, $B_4C$, or the like which is precipitated and localized in the crystal grain boundary of the steel material. The brittle material thus present is liable to suffer large thermal stresses in the steel material when the steel material is quenched.

While a boron steel has good mechanical strength, hardness, and toughness at its surface, these properties are not good enough in the inner structure of the steel because it is difficult to introduce or diffuse boron deeply into the steel material. Boron quickly reacts with the above separate impurity when the steel material is boronized.

When a steel material is carburized or nitrided, C or N is diffused into the steel material usually by a distance of about 0.1 mm or slightly over 0.25 mm at maximum from its surface. Therefore, while the carburizing or nitriding process is effective to harden the surface of the steel material, it fails to harden the inner structure of the steel material beyond the distance of 0.3 mm from the surface. In addition, the toughness of the carburized or nitrided steel material is lower than before it is carburized or nitrided.

Japanese laid-open patent publication No. 53-142933 proposes another surface treatment process of nitriding a steel material and then boronizing the steel material. According to the proposed surface treatment process, a temperature of heating the steel material in the boronizing process can be lower than a temperature in a boronizing process where the steel material would not be nitrided. Hence, the steel material can be formed into less strained products.

However, as described in the above publication, an Fe—B—N compound is generated only in the surface of the steel material according to the proposed surface treatment process. Since B or N does not enter deeply into the steel material, it is difficult for the process to improve the properties of the steel material in its inner structure.

DISCLOSURE OF THE INVENTION

It is therefore an object of the present invention to provide a steel material having excellent mechanical strength, hardness, and toughness, which is resistant to cracking when heated and can be formed into products at a high yield. It is also an object of the present invention to provide a method of manufacturing such a steel material.

According to the present invention, a steel material contains B ranging from 7 to 30 ppm by weight and N ranging from 10 to 70 ppm by weight.

The steel material which contains B in the above proportion has better mechanical strength, hardness, and toughness than steel materials free of B. N contained in the above proportion in the steel material is effective to suppress reactions between B and separate elements present as impurities in the steel material. Since brittle materials are thus prevented from being formed in the steel material, the steel material is prevented from cracking, and hence can be manufactured at a high yield.

B and N in the steel material may be present as hexagonal BN (h-BN) or cubic BN (c-BN) or may be combined with Fe and C and present as an Fe—C—B—N boronitride. However, for highest mechanical strength, hardness, and toughness, B and N are preferably present as an Fe (B, N) solid solution with Fe or an Fe (C, B, N) solid solution with Fe and C. Since the structure of the steel material gradually changes, thermal stresses produced in the steel material when heated are small. Therefore, the steel material is further prevented from cracking.

Typical examples of structures in which B and N are present as solid solutions include a ferrite, an austenite, a bainite (a transformed material produced when an austenite is cooled), or the like. A solid solution of Si, Mn, P, S, etc. which are contained in trace quantities in the steel material may be present in the Fe (B, N) solid solution or the Fe (C, B, N) solid solution.

When B and N are introduced as solid solutions in the Fe structure, they can be diffused deeply into the steel material, specifically, by a distance in excess of 0.3 mm. In a conventional case, a distance by which B is diffused in boron steel or by which N is diffused by nitridation is 0.1 mm, and slightly over 0.25 mm at maximum. Thus, B and N can be diffused by a much greater distance.

According to the present invention, there is provided a method of manufacturing a steel material containing B ranging from 7 to 30 ppm by weight and N ranging from 10 to 70 ppm by weight, comprising the steps of covering or surrounding a raw steel with a boron compound, and nitriding the raw steel with a nitriding gas while heating the raw steel in a temperature range from 1100 to 1750 K. The terminology "raw steel" herein refers to steel before surface treatment.

B and N contained in the steel material are diffused from the boron compound and the nitriding gas into the steel material. The steel material containing B in the above proportion has better mechanical strength, hardness, and toughness than steel materials free of B. N contained in the above proportion in the steel material is effective to suppress reactions between B and separate elements present as impurities in the steel material. Since brittle materials are thus prevented from being formed in the steel material, the steel material is prevented from cracking.

According to the present invention, it is possible to manufacture simply and easily a steel material which has high mechanical strength, hardness, and toughness and is resistant to cracking.

The reason why the raw steel is heated in the temperature range from 1100 to 1750 K is that if the temperature were lower than 1100 K, then N would easily be combined with a ferrite or a cementite and would exceed 70 ppm by weight. If the temperature exceeded 1750 k, then B would quickly be combined with separate elements such as Fe, Si, Ni, Mo, etc. in the raw steel, generating brittle borides which would make the steel material susceptible to cracking.

One preferred means for heating the raw steel is a high-frequency heating device because the high-frequency heating device is capable of heating the raw steel to a desired temperature within a short time, the steel material can be manufactured more efficiently.

Preferably, the raw steel is placed in a tubular member, and the nitriding gas is passed in the tubular member while the raw steel is being heated by the high-frequency heating device. Inasmuch as the nitriding gas is maintained in reliable contact with the raw steel, the raw steel can be nitrided efficiently with the high-frequency heating device.

The boron compound should preferably comprise hexagonal BN (h-BN) or $B_4C$. These boron compounds are easily available in the market, making it possible to reduce the cost of manufacture of the steel material.

The nitriding gas should preferably comprise a gas of $N_2$. Since the amount of N to be diffused into the raw steel is very small and the gas of $N_2$ is inactive, it is easy to control the amount of N diffused into the raw steel.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 2 is a table showing Vickers hardness of steel materials of the Inventive Examples 1 and 2 from one end to the other thereof;

FIG. 3 is a table showing tensile values and Charpy impact values of test pieces obtained from the steel materials of the Inventive Examples 1 and 2 and Comparative Example 1;

FIG. 5 is a table showing the relationship between heat-nitriding times, proportions by weight of boron, Rockwell hardness (C scale) of surfaces, tensile strength values, and fracture toughness values of steel materials;

FIG. 6 is a table showing the relationship between heat-nitriding times, proportions by weight of boron, Rockwell hardness (C scale) of surfaces, tensile strength values, and fracture toughness values of steel materials;

BEST MODE FOR CARRYING OUT THE INVENTION

Figure 1:
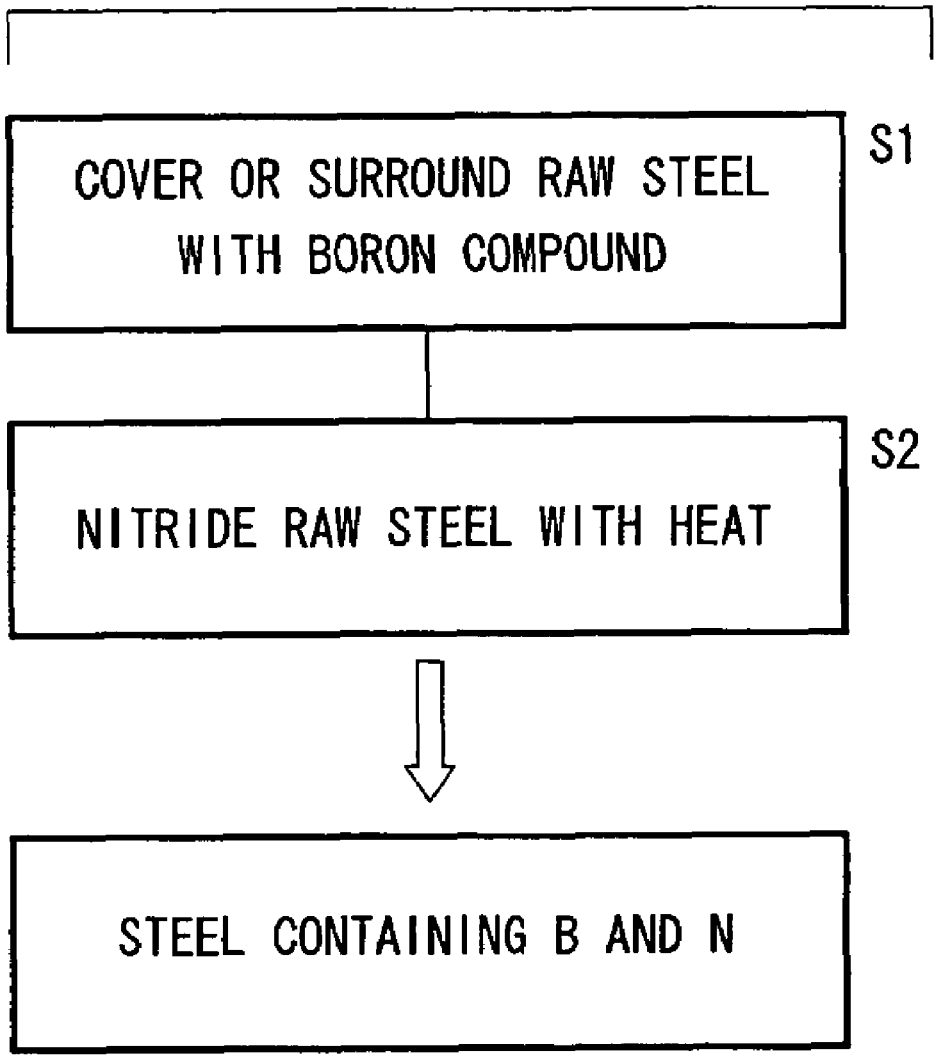
FIG. 1 is a flowchart of a process of manufacturing a steel material.

A steel material according to the present invention contains B and N which are present as an Fe (B, N) solid solution or an Fe (C, B, N) solid solution in a ferrite, austenite, a bainite, or the like. A solid solution of Si, Mn, P, S, or the like contained in a trace amount in the steel material may further be present in the above solid solution.

B is a component for improving the mechanical strength, hardness, and toughness of the steel material, as with the boron steel. B is contained in a proportion ranging from 7 to 30 ppm. If the proportion of B were smaller than 7 ppm, then it would not be effective enough to improve the above properties of the steel material. If the proportion of B were greater than 30 ppm, then the toughness of the steel material would be lowered. Preferably, B should be contained in a proportion ranging from 10 to 20 ppm.

N is a component for suppressing reactions between B and Fe, Si, Ni, Mo, etc. contained as separate impurities in the steel. N is effective to greatly suppress reactions between B and these separate elements, thus greatly suppressing the generation of brittle materials such as FeB, $Fe_2B$, $Fe_5SiB_2$, $Ni_4B_3$, $MoFeB_4$, $MO_2FeB_2$, $B_4C$. Accordingly, the steel material according to the present invention suffers much smaller thermal stresses generated when heated in various heat treatment processes such as quenching than general boron steels, and hence is resistant to cracking.

N is contained in a proportion ranging from 10 to 70 ppm. If the proportion of N were less than 10 ppm, then it would not be effective enough to prevent the steel material from cracking. If the proportion of N were greater than 70 ppm, then the hardness of the steel material would be lowered.

As described above, B and N are present as an Fe (B, N) solid solution or an Fe (C, B, N) solid solution in the steel material. The steel material exhibits better mechanical strength, hardness, and toughness than steel materials in which B and N are present as h-BN or c-BN.

In the steel material according to the present invention, B and N are diffused at a large distance. Specifically, B and N are introduced more deeply into the steel material than into boron steels and nitrided steel materials because B is greatly suppressed against reactions with separate elements in the steel material. Specifically, both B and N are occasionally present within an inner structure of the steel material according to the present invention beyond a distance of 30 to 70 mm from the surface of the steel material.

The structure of the steel material gradually varies from the surface to the inside thereof. Therefore, since thermal stresses produced when the steel material is heated are greatly reduced, the steel material is highly resistant to cracking.

As described above, B and N are diffused deeply within the steel structure according to the present invention. Consequently, the steel structure exhibits excellent mechanical strength, hardness, and toughness also within its inner structure, and hence is highly resistant to cracking.

The steel material according to the present invention is manufactured as follows:

FIG. 1 shows a flowchart of a process of manufacturing the steel material according to the present invention. As shown in FIG. 1, the manufacturing process has a first step S1 of covering or surrounding a raw steel with a boron compound, and a second step S2 of nitriding the raw steel with heat.

In the first step S1, a raw steel is covered with or surrounded by a boron compound. Specifically, if the raw steel is to be covered with a boron compound, then a coating film of a boron compound is formed on the surface of the raw steel. The coating film may be formed easily and simply by spraying a solution of a boron compound such as h-BN or the like dispersed in a solvent such as of xylene, toluene, acetone, or the like, to the surface of the raw steel, and then volatilizing away the solvent. Alternatively, the coating film may be formed by chemical vapor deposition (CVD) or physical vapor deposition (PVD).

If the raw steel is to be surrounded by a boron compound, then a powdery boron compound such as $B_4C$ or the like may be filled in a crucible which contains the raw steel therein.

In the second step S2, the raw steel covered with the coating film or surrounded by the powdery boron compound is nitrided with heat. In the nitriding process, the raw steel is nitrided, and B is diffused from the boron compound from the surface of the steel material into the inside of the steel material. N which is applied to nitride the raw steel is also introduced from the surface of the steel material into the inside of the steel material. As a result, the steel material described above is obtained.

A nitriding gas used to nitride the raw steel may be a mixed gas containing $NH_3$, such as a mixed gas of $NH_3$, $N_2$, and $H_2$ or a mixed gas of $NH_3$, $N_2$, and Ar, but should preferably be a gas consisting of $N_2$ only. The $N_2$ gas is preferable because the proportion by weight of N to be diffused into the raw steel is very small, i.e., ranges from 10 to 70 ppm, as described above, and the gas of $N_2$ is inactive enough to easily control the amount of N diffused into the raw steel.

The nitriding gas is introduced into the sintering or heating furnace when the temperature is in the range from 1100 to 1750 K. If the temperature were lower than 1100 K, then N would easily be turned into a solid solution in a ferrite, austenite, or bainite, and would have its proportion by weight in excess of 70 ppm. If the temperature were higher than 1750 K, then B would quickly be combined with separate elements such as Fe, Si, Ni, Mo, etc. in the raw steel, generating brittle borides which would make the steel material susceptible to cracking. When the temperature is outside of the above temperature range, an inactive nitriding gas such as Ar or the like may be introduced into the heating furnace. If the coating film is formed on the surfaced of the raw steel, then the heating furnace may be evacuated.

In the step S2, the raw steel may be heated by any heating means. However, a high-frequency induction heating device is particularly preferred because the device can raise the temperature of the raw steel within a short period of time to manufacture the steel material efficiently. If the high-frequency induction heating device is used, then the raw steel is preferably placed in a cylindrical member, and nitrided with a nitriding gas flowing through the cylindrical member. Inasmuch as the nitriding gas is maintained in reliable contact with the raw steel, the raw steel can be nitrided efficiently with the high-frequency induction heating device. The cylindrical member may be made of quartz or graphite.

In the nitriding process, the raw steel is heated for about 10 minutes to 2 hours in the heating furnace or for about 5 seconds to 5 minutes with the high-frequency induction heating device, depending on the thickness and volume of the raw steel. If the nitriding time were too long, then the proportions of B and N would exceed 30 ppm and 70 ppm, respectively.

EXAMPLES

1. Effects of B and N:

A raw steel of S50C according to JIS (Japanese Industrial Standard) in the form of a rectangular parallelepiped having a size of 50 mm×50 mm×100 mm was prepared. A solution of h-BN dispersed in xylene was sprayed to the surface of the raw steel. Then, the raw steel was left to stand at room temperature and dried, thus forming a coating film of h-BN on the surface of the raw steel.

The raw steel was then placed in a heating furnace, and heated to 1600 K at a rate of 10 K/min. Then, the raw steel was kept at 1600 K for 30 minutes. The raw steel was nitrided with heat into a steel material containing B and N. The steel material thus manufactured is referred to as Inventive Example 1. The heating furnace was evacuated until the temperature reached 1200 K, and $N_2$ was introduced into the heating furnace immediately after the temperature reached 1200 K.

The proportions by weight of B and N in the steel material of the Inventive Example 1 were determined as 17 ppm and 20 ppm, respectively, as a result of a quantitative analysis by way of absorption spectrophotometry.

A raw steel of the same size as described above was prepared and pressed into a crucible filled with a powder of $B_4C$, so that the raw steel was surrounded by the powder of $B_4C$.

The raw steel contained in the crucible was placed into a heating furnace, and nitrided with heat under the same conditions as with the Inventive Example 1, producing a steel material. The steel material thus manufactured is referred to as Inventive Example 2. The proportions by weight of B and N of the steel material of the Inventive Example 2 were 18 ppm and 50 ppm, respectively.

A cylindrical raw steel having a diameter of 10 mm and a length of 30 mm were heated with flames and then quenched. The raw steel thus prepared is referred to as Comparative Example 1. B and N were not detected in the raw steel of the Comparative Example 1.

The steel materials of the Inventive Examples 1, 2 and the Comparative Example 1 were measured for Vickers hardness. The Vickers hardness value of the surface of the raw steel of the Comparative Example 1 was 640. As shown in FIG. 2, the Vickers hardness values of the steel materials of the Inventive Examples 1, 2 from one end to the other were about 80 to 100 higher than the raw steel of the Comparative Example 1. This result indicates that the inclusion of B and N increases the hardness of a steel material. Since the hardness of the steel materials of the Inventive Examples 1, 2 is substantially uniform, it can be seen that B and N are diffused from the surface to the inner structure of these steel materials.

Test pieces for a tensile test and test pieces for a impact test were cut from the steel materials of the Inventive Examples 1, 2 and the Comparative Example 1, and measured for Vickers hardness values and Charpy impact values. The results of the test are shown in FIG. 3. Higher Charpy impact values indicate higher toughness values. It can be understood from FIG. 3 that the steel materials of the Inventive Examples 1, 2 have better tensile strength and toughness than the steel material of the Comparative Example 1.

It is apparent from the above results that it is possible to increase the hardness, mechanical strength, and toughness of a steel material by adding B and N to the steel material.

A steel material was produced in the same manner as with the Inventive Example 1 except that SCM 430 (according to JIS) was selected as raw steel. The steel material thus produced is referred to as Inventive Example 3.

Another steel material was produced in the same manner as with the Inventive Example 3 except that while the heating furnace was being evacuated, the raw steel was heated to 1200 K at a rate of 10 K/min, then kept at 1200 K for 30 minutes, heated to 1500 K whereupon a gas of $N_2$ was introduced, and then kept at 1650 K for 30 minutes. The steel material thus produced is referred to as Inventive Example 4.

A raw steel of SCM 430 having the same size as the Inventive Examples 3, 4 was dipped for 2 hours in a salt bath of 115 g of KCl, 20 g of $BaCl_2$, 7.5 g of NaF, 1 g of $B_2O_3$, and 5 g of ferroboron which were dissolved in 1000 $cm^3$ of water as a solvent. The raw steel thus dipped in the salt bath was boronized, and is referred to as Comparative Example 2.

The proportions by weight of B and N of the steel materials of the Inventive Examples 3, 4 and the Comparative Example 2 were determined as 19 ppm, 21 ppm, and 2 ppm, respectively, as a result of a quantitative analysis.

Figure 4:
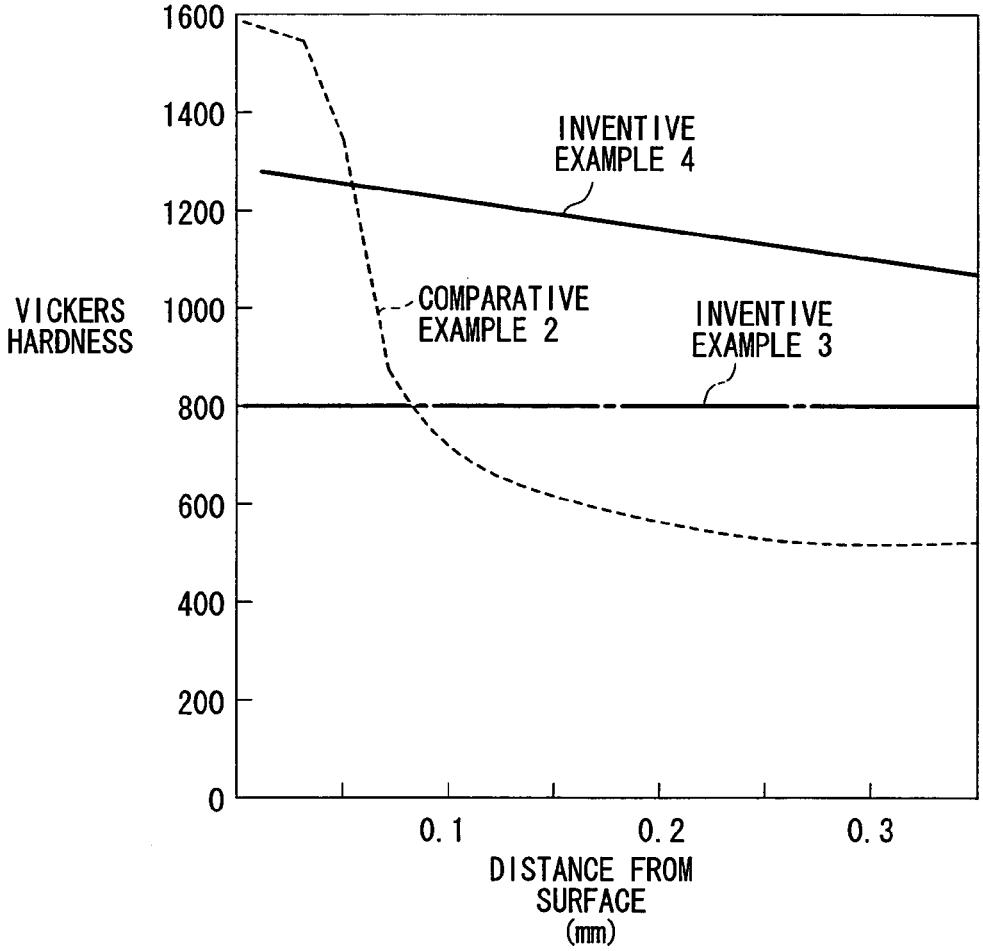
FIG. 4 is a graph showing the relationship between distances from the surfaces of steel materials of the Inventive Examples 3 and 4 and Comparative Example 2 and Vickers hardness thereof.

The steel materials of the Inventive Examples 3, 4 and the Comparative Example 2 were measured for Vickers hardness from their surface to inner structure. The relationships between distances from the surfaces and Vickers hardness values are illustrated in FIG. 4. It is apparent from FIG. 4 that whereas the Vickers hardness of the steel material of the Comparative Example 2 sharply decreases at a depth in excess of 0.05 mm, the Vickers hardness of the steel materials of the Inventive Examples 3, 4 is excellent even at a depth in excess of 0.3 mm. It can be understood from the results shown in FIG. 4 that B was diffused more deeply into the steel materials of the Inventive Examples 3, 4 than the steel material of the Comparative Example 2.

2. The relationships between heat-nitriding times and proportions by weight of boron, Rockwell hardness values (C scale) of surfaces, tensile strength values, and fracture toughness values of steel materials:

Various raw steels of rectangular parallelepiped having the same length and different base areas were prepared from the steel of SKS 63 (according to JIS). Solid solutions of B and N were produces in the forms of rectangular parallelepiped in the same manner as with the Inventive Example 1 except that a gas of $N_2$ was introduced when the temperature reached 1400 K and the raw steels were kept at the temperature for several periods of time, producing steel materials. Test pieces for a tensile test and test pieces for measuring fracture toughness ($K_{IC}$) were cut from the steel materials having bottom surface dimensions in excess of 40 mm×40 mm, and the tensile strength and fracture toughness ($K_{IC}$) were determined for each of the test pieces. The Rockwell hardness values (C scale, $H_{RC}$) of the surfaces of the steel materials were also measured. The measured results together with nitriding times (temperature-holding times) in the nitriding process and the proportions by weight of the contained B are shown in FIGS. 5 and 6.

FIGS. 5 and 6 clearly indicate that the properties of the steel materials can be controlled by setting the processing times.

Figure 7:
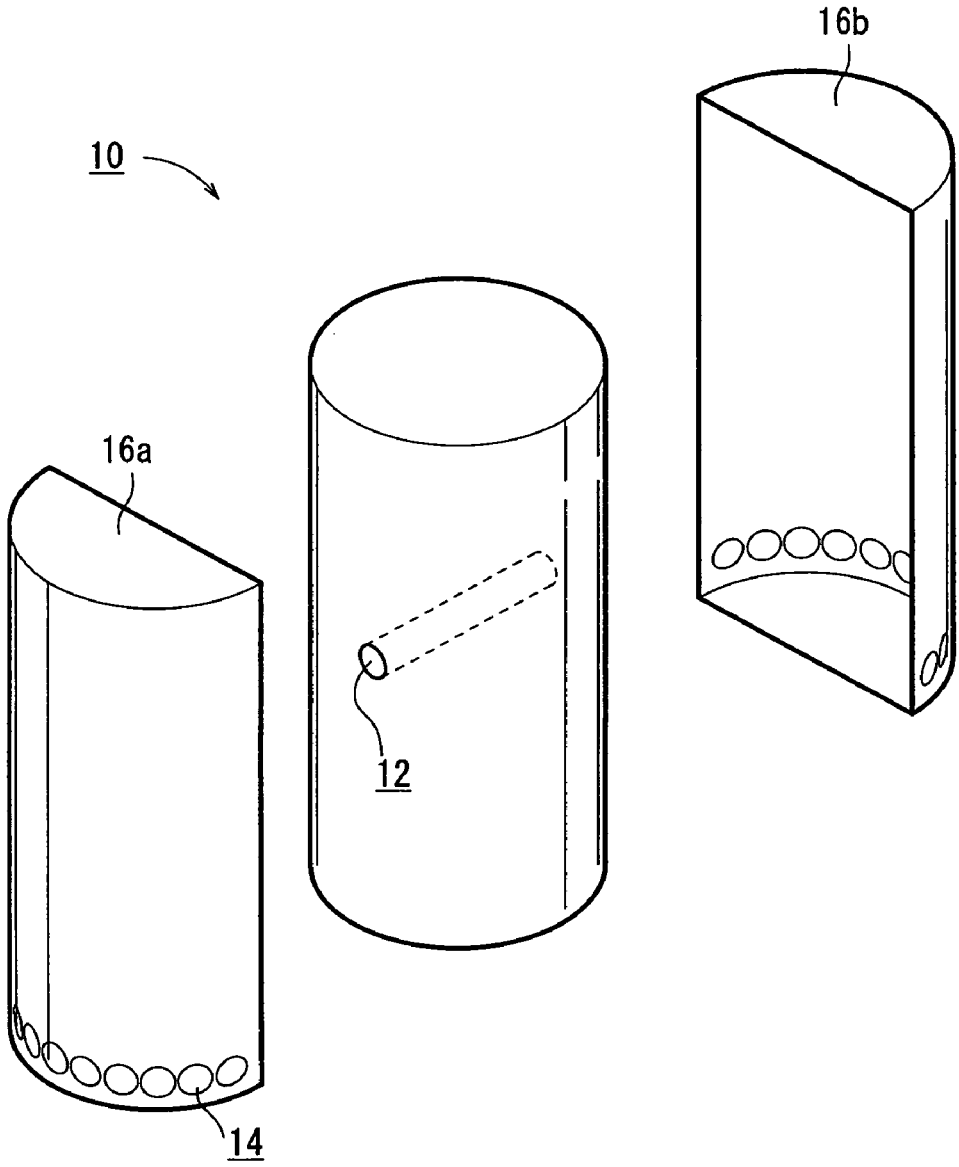
FIG. 7 is a perspective view of a raw steel and half pieces of a cylindrical member mounted on the raw steel.

3. Suppression of cracking:

As shown in FIG. 7, a cylindrical raw steel 10 of SCM 420 (according to JIS) having a diameter of 50 mm and a length of 200 mm was prepared. A solution of h-BN dispersed in xylene was sprayed to the surface of the raw steel, left at room temperature and dried, thus forming a coating film of h-BN (not shown) on the surface of the raw steel. A through hole 12 having a diameter of 8 mm was formed substantially centrally in the raw steel 10, the through hole 12 having an axis perpendicular to the axis of the raw steel 10.

Figure 8:
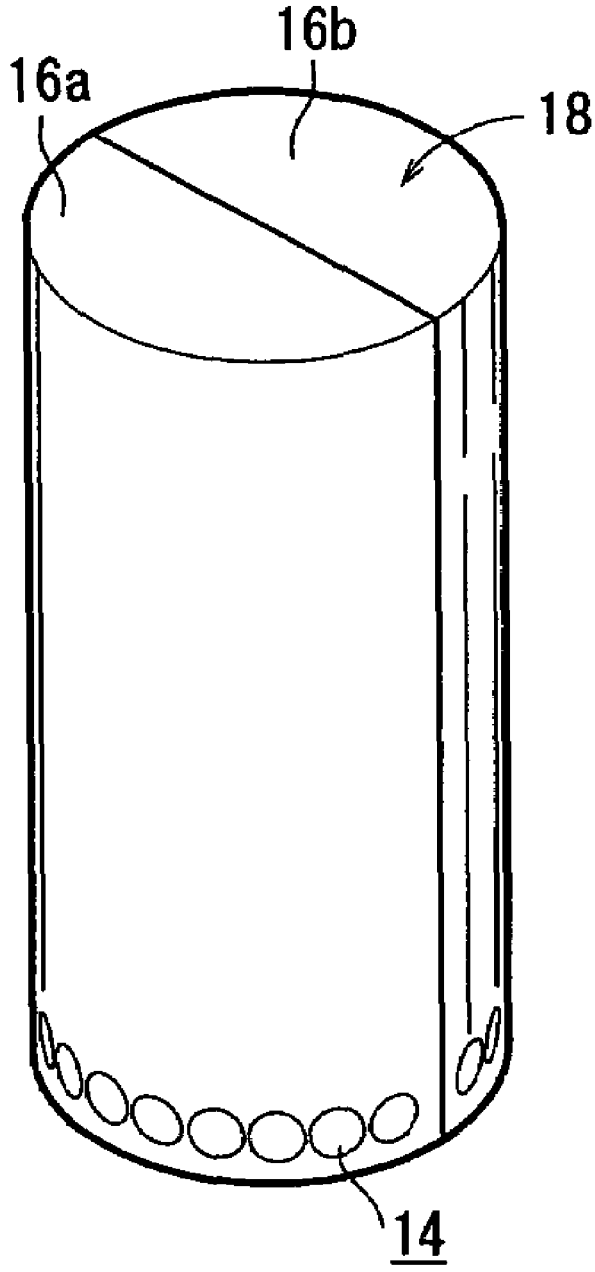
FIG. 8 is a perspective view of the cylindrical member mounted on the raw steel shown in FIG. 7.

Half pieces 16*a*, 16*b*, each semicylindrical in shape, having a plurality of holes 14 defined therein near one end thereof, were mounted on the raw steel 10, thus producing a cylindrical member 18 shown in FIG. 8. A gas of $N_2$ was passed through the holes 14 in the cylindrical member 18, and the cylindrical member 18 was rotated at a speed of 30 rpm. The raw steel 10 was heated by a high-frequency heating device under the conditions of 480 V, 48 kW, and 19 kHz for 10 seconds, thus producing a steel material. The steel material thus produced is referred to as Inventive Example 5.

Steel materials were prepared in the same manner as with the Inventive Example 5 except that the raw steels were heated for 15 seconds or 30 seconds. The steel materials thus produced are referred to as Inventive Examples 6, 7, respectively. In the Inventive Example 7, the raw steel 10 and the steel material were measured for B, N by a quantitative analysis. B, N were not detected in the raw steel 10, whereas B, N were detected as 17 ppm and 50 ppm, respectively, in the steel material.

For comparison, the raw steel 10 which was free of a coating film was heated and quenched by a high-frequency heating device, producing a steel material. Specifically, the raw steel 10 was heated for 8 seconds under the conditions of 460 V, 45 kW, and 19 kHz while the raw steel 10 was being rotated at a speed of 30 rpm in the atmosphere. The steel material thus produced is referred to as Comparative Example 3.

The steel materials of the Inventive Examples 5 through 7 and the Comparative Example 3 were inspected for cracking. It was confirmed that cracks were formed around the through hole 12 in 6 out of 10 specimens of the Comparative Example 3. No cracks were recognized in all 40 specimens of the Inventive Examples 5 through 7.

The steel materials of the Inventive Examples 5 through 7 and the Comparative Example 3 were measured for Vickers hardness from their surface to inner structure. The relationships between distances from the surfaces and Vickers hardness values are illustrated in FIG. 9.

Figure 9:
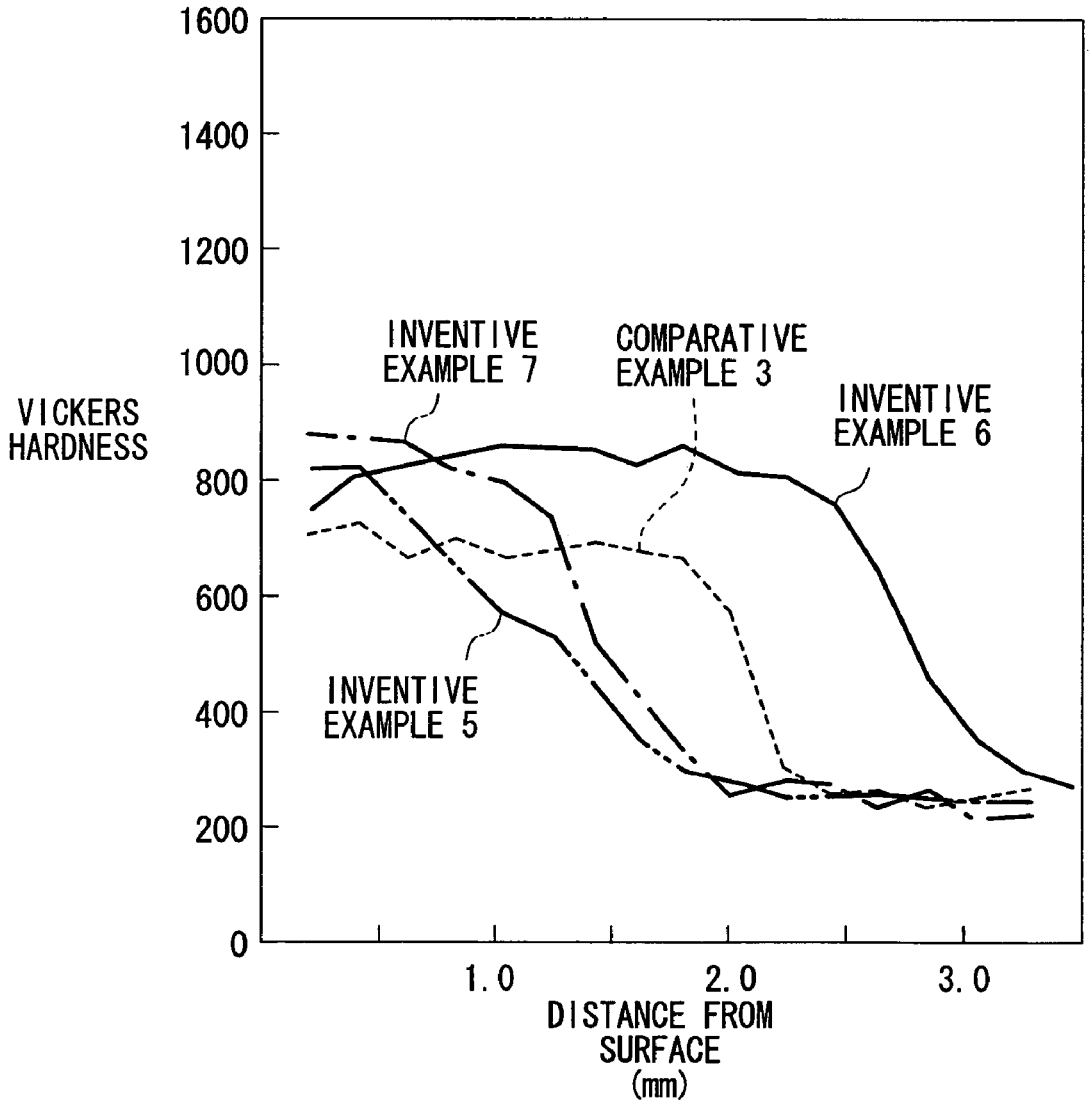
FIG. 9 is a graph showing the relationship between distances from the surfaces of steel materials of the Inventive Examples 5 through 7 and Comparative Example 3 and Vickers hardness thereof.

It is apparent from FIG. 9 that whereas the Vickers hardness of the steel material of the Comparative Example 3 sharply decreases at a depth in excess of 2 mm, the Vickers hardness of the steel materials of the Inventive Examples 5 through 7 is gradually lowered. It can be understood from the results shown in FIG. 9 that the structure of the steel material of the Comparative Example 3 sharply changes, and the structure of the steel materials of the Inventive Examples 5 through 7 gradually changes. The steel materials of the Inventive Examples 5 through 7 having such structure suffer much smaller thermal stresses produced when heated than the steel material of the Comparative Example 3. It appears that this is the reason why no cracks were formed in the steel materials of the Inventive Examples 5 through 7.

Although certain preferred embodiments of the present invention have been shown and described in detail, it should be understood that various changes and modifications may be made therein without departing from the scope of the appended claims.

What is claimed is:

1. A steel material comprising a hardened layer on a surface of the steel material, the hardened layer containing B ranging from 7 to 30 ppm by weight and N ranging from 10 to 70 ppm by weight, Vickers hardness of the hardened layer being in excess of 720 and the hardened layer having a depth in excess of 0.3 mm, wherein B and N are contained as an Fe (B, N) solid solution or an Fe (C, B, N) solid solution or an Fe—C—B—N boronitride, Fe and C are constituent elements of the steel material, and concentration of the Fe (B, N) solid solution or concentration of the Fe (C, B, N) solid solution or concentration of the Fe—C—B—N boronitride decreases from the surface to the inner structure of the hardened layer, and the Vickers hardness in the hardened layer decreases from the surface to the inner structure of the hardened layer wherein said steel material is made by covering or surrounding a raw steel with a boron compound comprising hexagonal BN or $B_4C$ and nitriding said raw steel with a nitriding gas while heating said raw steel.

* * * * *